US010087120B2

(12) United States Patent
Allen

(10) Patent No.: US 10,087,120 B2
(45) Date of Patent: Oct. 2, 2018

(54) CROWD DISPERSING COMPOSITION

(71) Applicant: Richard Allen, Temecula, CA (US)

(72) Inventor: Richard Allen, Temecula, CA (US)

( * ) Notice: Subject to any disclaimer, the term of this patent is extended or adjusted under 35 U.S.C. 154(b) by 56 days.

(21) Appl. No.: 15/437,260

(22) Filed: Feb. 20, 2017

(65) Prior Publication Data

US 2018/0237357 A1 Aug. 23, 2018

(51) Int. Cl.
*A61K 36/00* (2006.01)
*C06D 7/00* (2006.01)

(52) U.S. Cl.
CPC ..... *C06D 7/00* (2013.01)

(58) Field of Classification Search
CPC ..... A61K 36/00
USPC ..... 424/725
See application file for complete search history.

(56) References Cited

U.S. PATENT DOCUMENTS

| | | | |
|---|---|---|---|
| 3,607,780 | A | 9/1971 | Scott |
| D409,740 | S | 5/1999 | Gallagher et al. |
| 6,412,416 | B1 | 7/2002 | Rouse |
| 6,688,032 | B1 | 2/2004 | Gonzalez et al. |
| 8,888,550 | B1 | 11/2014 | Conner |
| 2003/0170180 | A1 | 9/2003 | Bahary |
| 2009/0013893 | A1 | 1/2009 | Vasel et al. |

FOREIGN PATENT DOCUMENTS

CN 105037038 A * 11/2015

* cited by examiner

*Primary Examiner* — Michael V Meller

(57) ABSTRACT

A crowd dispersing composition includes a mixture including limburger cheese, rotten eggs, sulfur compounds having a smell of rotten food, rotten fish and rotten meat. The mixture is to be sprayed into a crowd of people to disperse the crowd.

1 Claim, 2 Drawing Sheets

CROWD DISPERSING COMPOSITION

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to crowd dispersing sprays and more particularly pertains to a new crowd dispersing spray for providing such a strong, repugnant smell that a crowd of people will attempt to avoid the spray.

BRIEF SUMMARY OF THE INVENTION

An embodiment of the disclosure meets the needs presented above by generally comprising a mixture including limburger cheese, rotten eggs, sulfur compounds having a smell of rotten food, rotten fish and rotten meat. The mixture is to be sprayed into a crowd of people to disperse the crowd.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
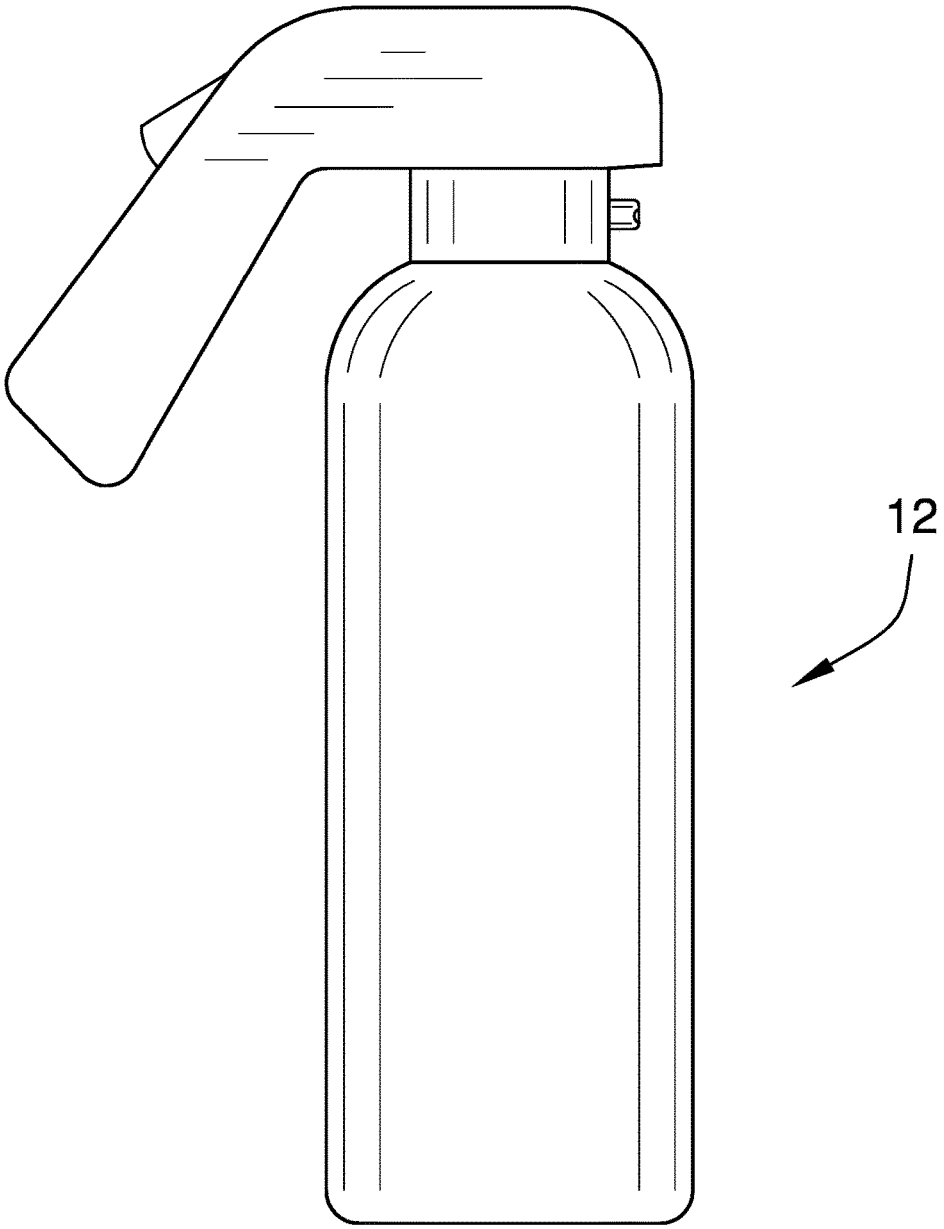
FIG. 1 is a side view of a crowd dispersing composition according to an embodiment of the disclosure.
Figure 2:
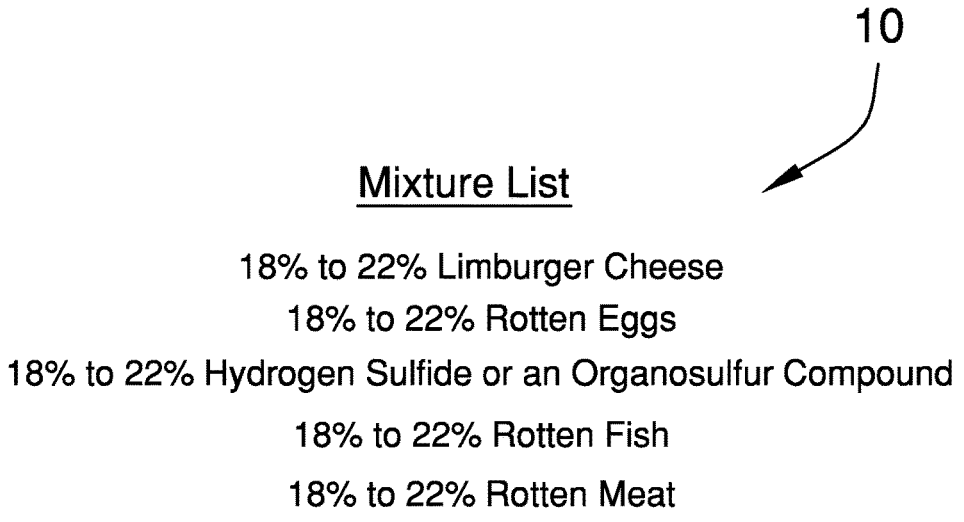
FIG. 2 is a schematic view of an embodiment of the disclosure.

With reference now to the drawings, and in particular to FIGS. 1 and 2 thereof, a new crowd dispersing spray embodying the principles and concepts of an embodiment of the disclosure and generally designated by the reference numeral 10 will be described.

As best illustrated in FIGS. 1 and 2, the crowd dispersing composition 10 generally comprises a mixture of materials each having a highly objectionable odor component. The materials are blended together and the placed in a canister to allow the spraying of the mixture into a crowd of people to cause the crowd to scatter and disperse.

The composition includes a mixture comprising limburger cheese, rotten eggs, sulfur compounds having a smell of rotten food, rotten fish and rotten meat. The sulfur compounds may include hydrogen sulfide or an organosulfur compound.

More specifically, the mixture may contain by weight the following components:

- 18% to 22% limburger cheese;
- 18% to 22% rotten eggs;
- 18% to 22% hydrogen sulfide or an organosulfur compound;
- 18% to 22% rotten fish; and
- 18% to 22% rotten meat.

The components may be blended together in any conventional manner such that the mixture comprises a thin fluid or fine powder that may be easily sprayed under pressurized gas from a canister 12. Alternatively, a motorized sprayer may be utilized instead of gas under pressure.

In use, the mixture may be deployed to police, security personnel and the like to be used for dispersing a crowd of people who are unlawfully gathered or otherwise pose a security risk. The mixture will not harm people, such as can happen with pepper spray and other similar types of crowd control measures, but will cause people to avoid the smell. Moreover, the mixture may be removed from clothing and skin by conventional washing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pressurized canister consisting essentially of:

18% to 22% limburger cheese;

18% to 22% rotten eggs;

18% to 22% hydrogen suffice or an organosulfur compound;

18% to 22% rotten fish; and

18% to 22% rotten meat.

* * * * *